US009499388B2

(12) United States Patent
Lasnier et al.

(10) Patent No.: US 9,499,388 B2
(45) Date of Patent: Nov. 22, 2016

(54) FILLABLE BOTTLE FOR DISPENSING A FLUID PRODUCT

(71) Applicants: Jacky Lasnier, Sainte Marguerite sur Duclair (FR); Thomas Roosel, Notre Dame d'Aliermont (FR)

(72) Inventors: Jacky Lasnier, Sainte Marguerite sur Duclair (FR); Thomas Roosel, Notre Dame d'Aliermont (FR)

(73) Assignee: Albea Le Treport S.A.S (FR)

( * ) Notice: Subject to any disclaimer, the term of this patent is extended or adjusted under 35 U.S.C. 154(b) by 0 days.

(21) Appl. No.: 14/054,372

(22) Filed: Oct. 15, 2013

(65) Prior Publication Data

US 2014/0102585 A1 Apr. 17, 2014

(30) Foreign Application Priority Data

Oct. 15, 2012 (FR) ..... 12 59829

(51) Int. Cl.

| | |
|---|---|
| ***B67D 7/02*** | (2010.01) |
| ***B05B 11/00*** | (2006.01) |
| *A45D 34/00* | (2006.01) |
| *A45D 34/02* | (2006.01) |

(52) U.S. Cl.

CPC ..... *B67D 7/0294* (2013.01); *B05B 11/0056* (2013.01); *A45D 34/00* (2013.01); *A45D 34/02* (2013.01); *A45D 2200/057* (2013.01); *B05B 11/3049* (2013.01)

(58) Field of Classification Search

CPC ..... B67D 7/74; B67D 7/0294

USPC ..... 141/18, 113, 114, 115, 116, 118, 274, 141/311 R, 319, 320, 321, 325, 326, 330, 141/346, 347, 363, 364, 365, 366; 222/153.04, 402.19

See application file for complete search history.

(56) References Cited

U.S. PATENT DOCUMENTS

| | | | | | |
|---|---|---|---|---|---|
| 545,147 | A | * | 8/1895 | Benner | 141/29 |
| 2,345,854 | A | * | 4/1944 | Margolies | 239/355 |
| 2,401,674 | A | * | 6/1946 | Vizay | 141/294 |
| 2,433,989 | A | * | 1/1948 | Hansen | 137/454 |
| 2,714,805 | A | * | 8/1955 | Zellweger | 141/330 |
| 2,906,300 | A | * | 9/1959 | Becher | 141/18 |
| 3,094,250 | A | * | 6/1963 | Molyneaux et al. | 222/207 |
| 3,205,919 | A | * | 9/1965 | Kovacs | 141/20.5 |
| 3,246,807 | A | * | 4/1966 | Micallef | 222/207 |
| 3,343,718 | A | * | 9/1967 | Siegel et al. | 222/1 |

(Continued)

FOREIGN PATENT DOCUMENTS

| | | | | |
|---|---|---|---|---|
| FR | 2802447 A1 | | 6/2001 | |
| WO | WO 9321103 A1 | * | 10/1993 | B67D 5/00 |

*Primary Examiner* — Mark A Laurenzi
*Assistant Examiner* — Andrew Schmid
(74) *Attorney, Agent, or Firm* — St. Onge Steward Johnston & Reens LLC

(57) ABSTRACT

A fillable bottle for dispensing a fluid product provided with a relief valve for filling the reservoir and putting a source of product into communication with the reservoir for filling, the relief valve including a passage for communication between the source and the reservoir, the passage having a seat provided with a valve which is mobile relative to the seat between a sealed closed position and an open position of the passage, the valve being mobile between its closed and open positions under the effect of the gravity induced by the positioning of the bottle respectively in an upright position and in a turned-over position, the bottle including at least one bell in the reservoir, the bell being in communication with the reservoir in the upright position and isolated from the reservoir in the turned-over position in order to not be filled by the product coming from the source.

15 Claims, 4 Drawing Sheets

(56) References Cited

U.S. PATENT DOCUMENTS 3,556,171 A * 1/1971 Gangwisch et al. ..... 141/3
4,277,001 A * 7/1981 Nozawa ..... 222/321.4
5,072,762 A * 12/1991 Jimenez ..... 141/329
5,150,823 A * 9/1992 Sugita ..... 222/386
5,431,205 A * 7/1995 Gebhard ..... 141/351
5,524,680 A * 6/1996 de Laforcade ..... 141/18
5,839,623 A * 11/1998 Losenno et al. ..... 222/402.1
6,237,649 B1 * 5/2001 Moisio et al. ..... 141/100
6,240,979 B1 * 6/2001 Lorscheidt ..... 141/2
6,390,156 B1 * 5/2002 Hetherington et al. ..... 141/351
6,418,987 B1 * 7/2002 Colasacco ..... 141/384
6,648,180 B2 * 11/2003 Moon et al. ..... 222/185.1
6,863,093 B2 * 3/2005 Garcia et al. ..... 141/2
7,210,508 B2 * 5/2007 Behar ..... 141/329
7,377,296 B2 * 5/2008 Gueret ..... 141/352
7,665,635 B2 * 2/2010 Ramet et al. ..... 222/321.7
8,079,388 B2 * 12/2011 Turgeman ..... 141/113
8,118,066 B2 * 2/2012 Muhlhausen et al. ..... 141/18
8,152,025 B2 * 4/2012 Foster ..... 222/129
8,459,312 B2 * 6/2013 Manera et al. ..... 141/27
8,545,441 B2 * 10/2013 Matusch ..... 604/89
8,695,896 B2 * 4/2014 Tu ..... 239/333
8,739,839 B2 * 6/2014 Muller ..... 141/18
2005/0016622 A1 * 1/2005 Risch et al. ..... 141/113
2005/0284891 A1 * 12/2005 Ramet et al. ..... 222/321.7
2007/0119517 A1 * 5/2007 Grace ..... 141/319
2008/0005828 A1 * 1/2008 Slade ..... 4/231
2009/0194191 A1 * 8/2009 Turgeman ..... 141/18
2011/0024465 A1 * 2/2011 Roosel et al. ..... 222/321.1
2011/0240677 A1 * 10/2011 Dwyer ..... 222/256
2011/0309110 A1 * 12/2011 Dumont et al. ..... 222/321.7
2012/0090730 A1 * 4/2012 Dumont et al. ..... 141/2
2012/0090733 A1 * 4/2012 Turgeman ..... 141/113
2012/0234432 A1 * 9/2012 Lamboux ..... 141/2
2012/0255647 A1 * 10/2012 Dumont et al. ..... 141/311 R
2012/0312842 A1 * 12/2012 Dumont et al. ..... 222/321.9
2012/0312843 A1 * 12/2012 Dumont et al. ..... 222/321.9
2013/0008981 A1 * 1/2013 Bloc et al. ..... 239/480
2013/0019991 A1 * 1/2013 Muller ..... 141/18
2014/0060695 A1 * 3/2014 Dumont et al. ..... 141/18
2014/0069551 A1 * 3/2014 Lasnier et al. ..... 141/18
2014/0083557 A1 * 3/2014 George et al. ..... 141/2
2014/0102584 A1 * 4/2014 Lasnier et al. ..... 141/18
2014/0102585 A1 * 4/2014 Lasnier et al. ..... 141/18
2014/0137983 A1 * 5/2014 Tu ..... 141/113
2014/0305543 A1 * 10/2014 Lasnier et al. ..... 141/18

* cited by examiner

FILLABLE BOTTLE FOR DISPENSING A FLUID PRODUCT

FIELD OF THE INVENTION

The invention relates to a fillable bottle for dispensing a fluid product, as well as to a unit comprising such a bottle and a source of product intended for filling said bottle.

BACKGROUND OF THE INVENTION

In particular, the fillable bottle allows the dispensing of a liquid product, for example of a cosmetic care, make-up or perfuming product, or a pharmaceutical product.

The fillable bottle comprises a body having an outer wall wherein a reservoir for conditioning the product is formed, as well as a device for the dispensing of the conditioned product which is mounted in a sealed manner on said body. In particular, the device for dispensing can include means for sampling in the form of a manually-actuated pump which is supplied with conditioned product, said pump being arranged for dispensing the product under pressure, for example in the form of an aerosol. Alternatively, the device for dispensing can include means for applying the product, for example in the form of a ball.

In an application example, the fillable bottles according to the invention allow the dispensing of product samples, in particular for a volume of product conditioned in the reservoir which is between 1 and 10 ml. In particular, the samples dispensed as such can allow a customer to test the product, the bottles then being qualified as sample tester bottles. Alternatively, the bottles can be referred to as "bag" is that they make it possible to easily transport a reduced volume of product, in opposition to bottles of a higher capacity which are in general heavy and cumbersome as they are opulent-looking.

In these applications, for example for reasons of logistics, practicality or environmental for recycling, it may be desirable to be able to refill the reservoir with product from a source of said product. Indeed, it is not very practical for a user to carry out the filling of the reservoir using a small funnel and not very ecological to discard an empty bottle in order to replace it with a full bottle constituting a refill.

Fillable bottles are already available for sale, wherein the body is provided with a relief valve for filling the reservoir which is arranged to allow for the putting into communication of a source of product with said reservoir for its filling. In particular, the relief valve comprises a passage for communication between the source and the reservoir, said passage having a seat provided with a valve which is mobile relatively to said seat between a sealed closed position and an open position of said passage.

In order to carry out the filling, prior art proposes to use a source bottle comprising a pump for dispensing, with the valve being displaced by means of the nozzle of said pump. In particular, the sealed contact of the nozzle on the valve allows the reversible opening of said valve as well as the actuating of the pump in order to inject source product into the reservoir through the relief valve.

However, this embodiment requires removing beforehand the push-button provided on the nozzle of the pump of the source bottle and actuating several times said nozzle in order to inject a sufficient volume of product, which is difficult and not very intuitive for the user. Furthermore, an incorrect putting of the push-button back on the nozzle after filling is potentially detrimental to the later proper operation of the source bottle.

Moreover, this embodiment poses problems of sealing during the filling, in particular due to the difficulty in correctly positioning the nozzle in a sealed contact on the valve and the injection pressure of the product through the relief valve. Furthermore, relief valves according to prior art are not compatible with the various configurations of off-the-shelf nozzles, which limits the possibilities of filling a bottle provided with such a relief valve, except when providing a set of adapters which further complicates the carrying out of a sealed filling.

During the filling also arises the problem of the volume of product introduced into the reservoir which has to be sufficient in order to allow the later use of the bottle while not being excessive in order to prevent the risks of overpressure inside said reservoir. Indeed, in particular in relation with a product containing alcohol or another volatile solvent, an increase in temperature induces an increase in the pressure in the reservoir which, in the case of an excessive filling, can reach a value that is detrimental for the use of the bottle, in particular in relation to a violent projection of product during the dispensing or even product leakage.

SUMMARY OF THE INVENTION

The invention aims to improve prior art by proposing especially a bottle of which the gesture for filling is simplified while still avoiding the appearance of an overpressure due to an excessive filling of the reservoir.

To this effect, according to a first aspect, the invention proposes a fillable bottle for dispensing a fluid product comprising a body having an outer wall wherein a reservoir intended for the conditioning of said product is formed, said bottle comprising a device for dispensing said conditioned product which is mounted in a sealed manner on said body, said bottle being provided with a relief valve for filling the reservoir which is arranged to allow the putting into communication of a source of product with said reservoir for its filling, said relief valve comprising a passage for communication between said source and said reservoir, said passage having a seat provided with a valve which is mobile relatively to said seat between a sealed closed position and an open position of said passage, the valve being arranged in order to be mobile between its closed and open positions under the effect of the gravity which is induced by the positioning of the bottle respectively in an upright position and in a turned-over position, said bottle comprising at least one bell arranged in the reservoir, said bell being arranged for, in upright position, to be in communication with said reservoir and, in turned-over position, be isolated from said reservoir in order to not be filled by the product coming from the source.

According to a second aspect, the invention proposes a unit comprising such a fillable bottle and a source of product intended for the filling of said fillable bottle, said source comprising a product reservoir which is provided with a socket arranged in order to allow the sealed connection of the relief valve for filling on the source reservoir by putting the passage into communication with said reservoir.

BRIEF DESCRIPTION OF THE DRAWINGS

Other objects and advantages of the invention will appear in the following description, made in reference to the annexed figures, wherein.

DETAILED DESCRIPTION OF THE INVENTION

Figure 1:
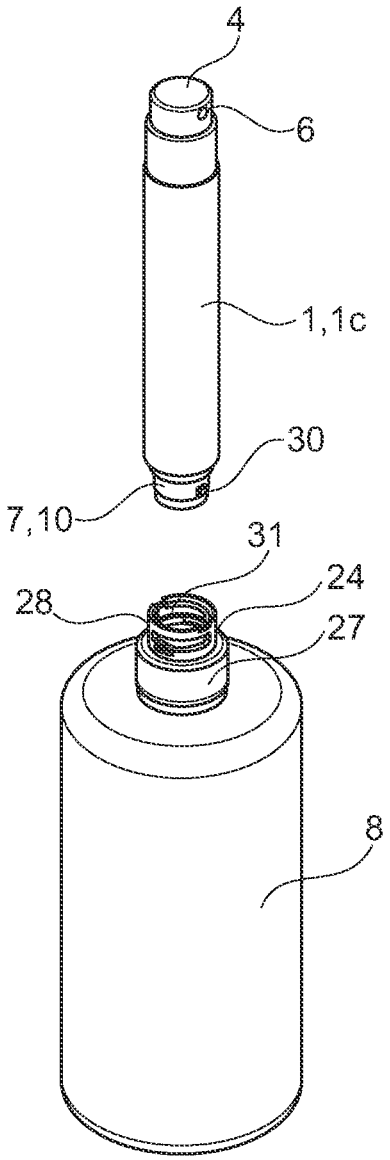
FIG. 1 shows in perspective the unit formed by a fillable bottle and by a source bottle, each being assembled and ready to be connected.
Figure 2:
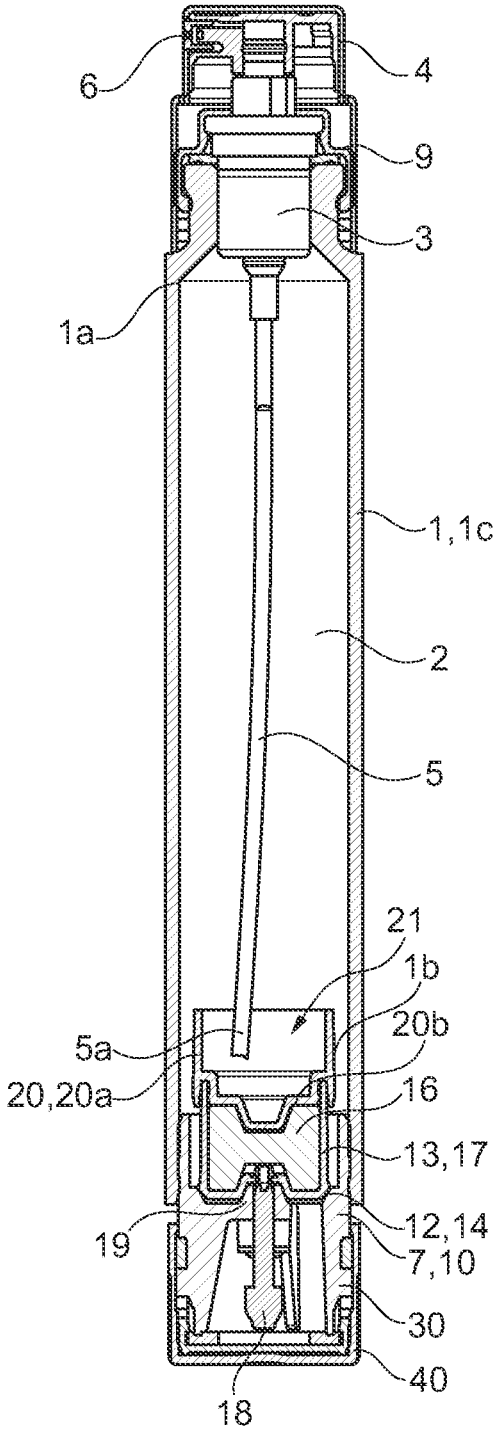
FIG. 2 shows as a longitudinal section a fillable bottle according to an embodiment of the invention.
Figure 4A:
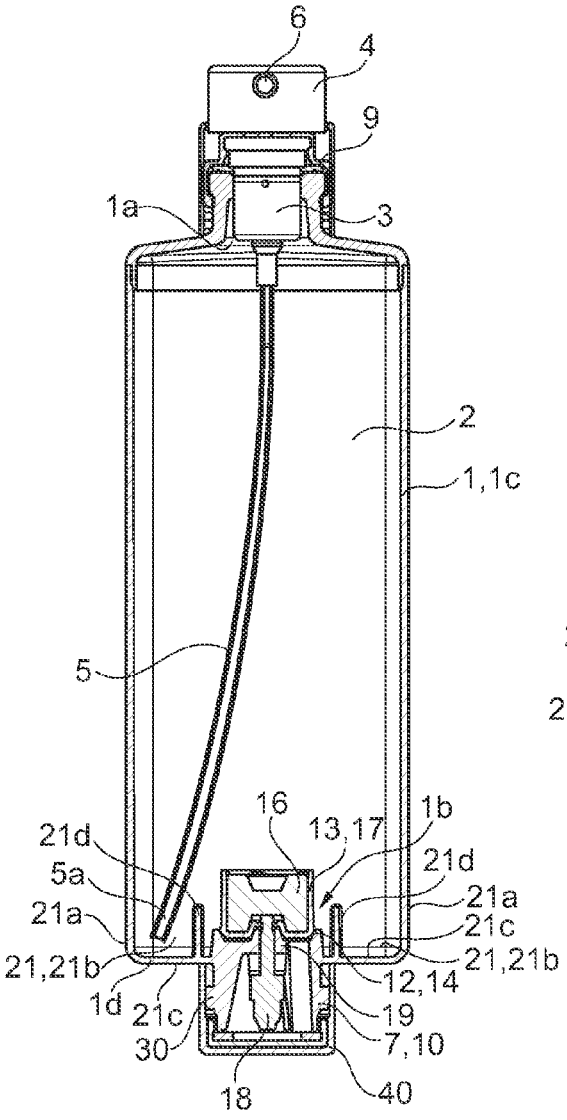
FIGS. 4*a*-4*b* show as a longitudinal section a fillable bottle according to another embodiment of the invention, the FIG. 4*b* being a partial view as a cut-off perspective of the bottle of FIG. 4*a;*
Figure 4B:
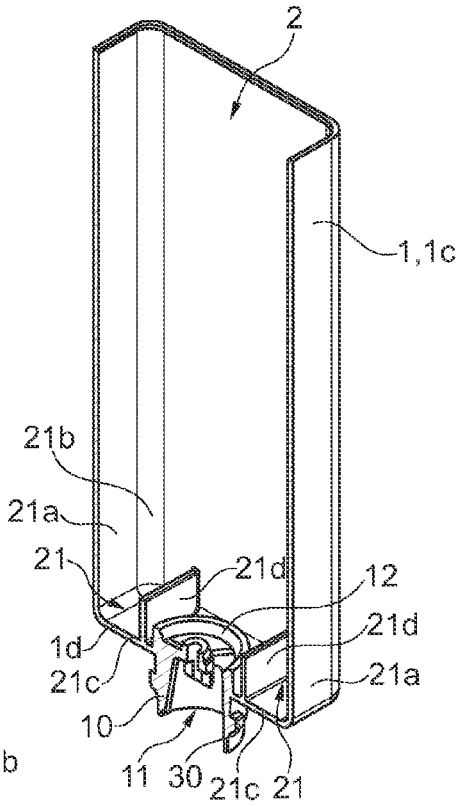

In the description, the terms of positioning in space are taken in reference to the upright position of the fillable bottle such as shown in particular in FIGS. 2 and 4.

In relation with the figures, a fillable bottle intended to contain a fluid product for dispensing it is described hereinbelow. In particular examples, the product can be liquid, especially a cosmetic care, make-up or perfuming product, or a pharmaceutical product.

The fillable bottle comprises a body 1 having an outer wall 1*c* wherein a reservoir 2 for conditioning the product is formed. According to a particular application, the reservoir 2 can have a capacity between 1 and 10 ml in such a way as to allow the dispensing of samples of product.

In the embodiments shown, the body 1 is rigid, in particular by having a rigidity that is sufficient so that the volume of the reservoir 2 remains substantially constant, even if the internal pressure varies. The body 1 can be of a single block, for example made via injection blow moulding or extrusion blow-moulding, or in several injected portions then assembled, for example via ultrasonic welding, or via laser, or via rotating friction, of rigid plastic material, of metal, for example of aluminium, or of glass.

The bottle comprises a device for the dispensing of the conditioned product which is mounted in a sealed manner in the body 1. In the embodiment shown, the device for dispensing comprises a pump 3 actuated manually by means of a push-button 4, said pump being supplied with product by the intermediary of a plunger tube 5 which is arranged in the reservoir 2.

However, the invention is not limited to a method for dispensing the product. In particular, other types of means for sampling the product in the reservoir 2 can be considered. The device for dispensing can also include means for applying the product, for example in the form of a ball.

The push-button 4 comprises a dispensing orifice 6 and an upper zone allowing the user to exert a press of the finger on it so as to displace the nozzle of the pump 3 on its supply stroke of said orifice with product under pressure. In the embodiment shown, the push-button 4 is provided with a spray nozzle which is arranged in order to radially dispense an aerosol of the product through the dispensing orifice 6. However, in particular for a nasal spray tip, the push-button 4 can allow an axial dispensing of the product. Alternatively, the product can be dispensed in the form of a small amount or layer.

The bottle is provided with a relief valve 7 for filling the reservoir 2 which is arranged to allow the putting into communication of a source 8 of product with said reservoir for its filling. In relation with the figures, the body 1 has an upper opening 1*a* wherein is mounted the pump 3 by the intermediary of a collar—hoop 9 unit, and a lower opening 1*b* which is provided with the relief valve for filling 7.

The lower opening 1*b* is formed in the bottom of the body 1 and the relief valve for filling 7 comprises a skirt 10 which extends axially in a peripheral manner under said opening. As such, a passage 11 for communication is formed between the source 8 of product and the reservoir 2, said passage extending in the skirt 10.

In FIG. 2, the skirt 10 is added under the body 1. To this effect, the relief valve for filling 7 comprises a hollow casing of which the upper wall is press-fitted into the lower opening 1*b*, the skirt 10 being formed under said upper wall in order to extend to the exterior of the body 1. In relation with the FIG. 4, the skirt 10 is formed of a single part with the bottom 1*d* of the outer wall 1*c* of the body 1.

The passage 11 for communication has a seat 12 provided with a valve 13 which is mobile relatively to said seat between a sealed closed position and an open position of said passage. In particular, the seat 12 can be formed on the inside periphery of the skirt 10.

The bottle can further include a device for locking the valve 13 in closed position which makes it possible to prevent the displacement of said valve into open position, in particular between two fillings, in order to prevent the product from leaking through the relief valve 7. Furthermore, the device for locking can be arranged in order to be deactivated by leaving the valve 13 in closed position in order to release the later displacement of said valve into open position.

Figure 3A:
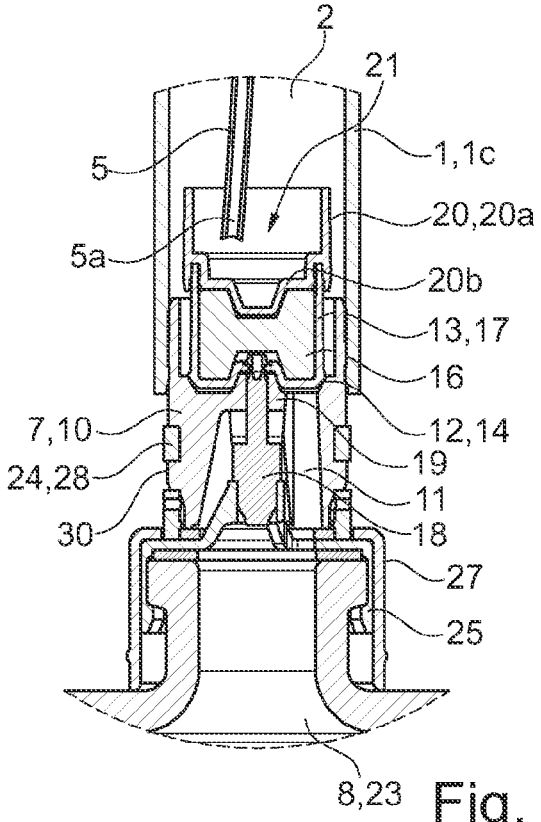
FIGS. 3*a*-3*b* show partially as a longitudinal section the connection of the fillable bottle according to FIG. 2 on a source bottle, respectively in upright position for sealed closure (FIG. 3*a*) and in turned-over position for the opening of the passage for filling (FIG. 3*b*)
Figure 3B:
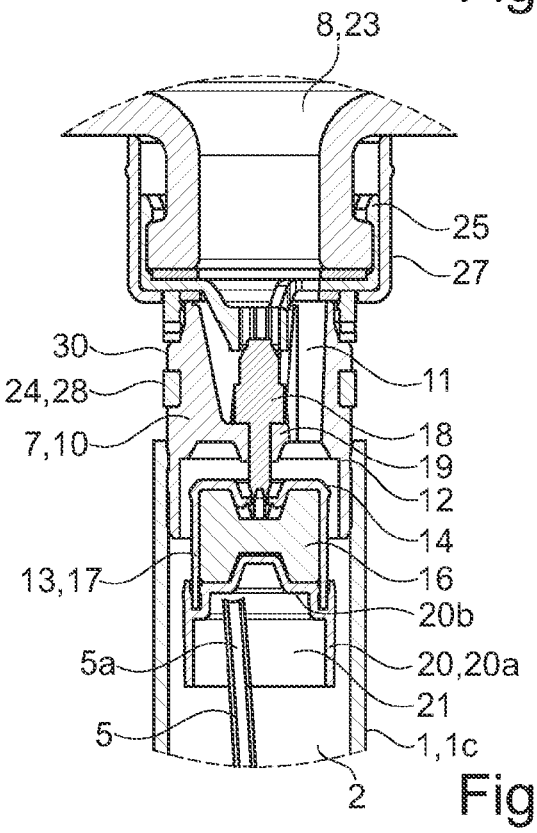
Figure 5A:
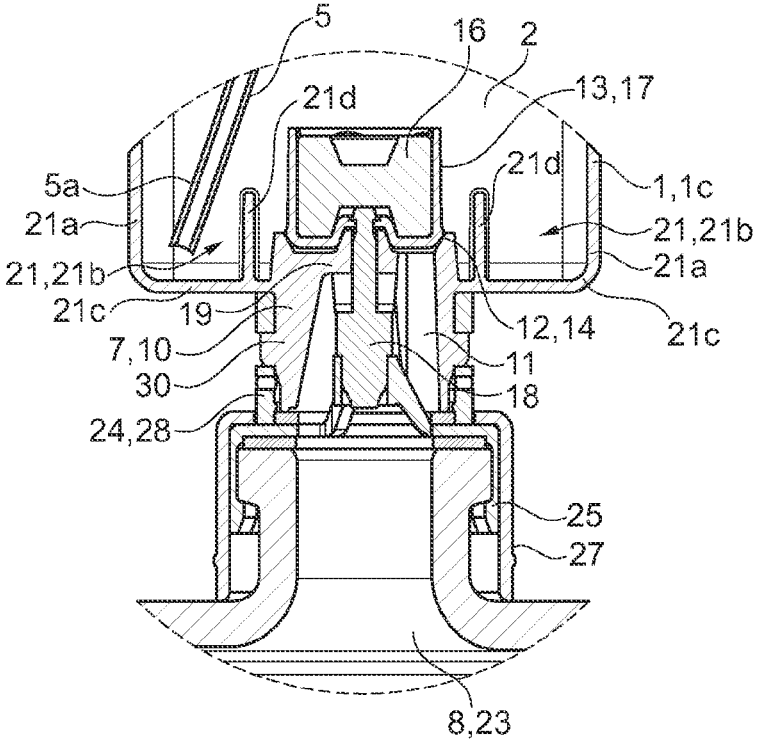
FIGS. 5*a*-5*b* show partially and as a longitudinal section the connection of the fillable bottle according to FIG. 4*a* on a source bottle, respectively in upright position for sealed closure (FIG. 5*a*) and in turned-over position for the opening of the passage for filling (FIG. 5*b*).
Figure 5B:
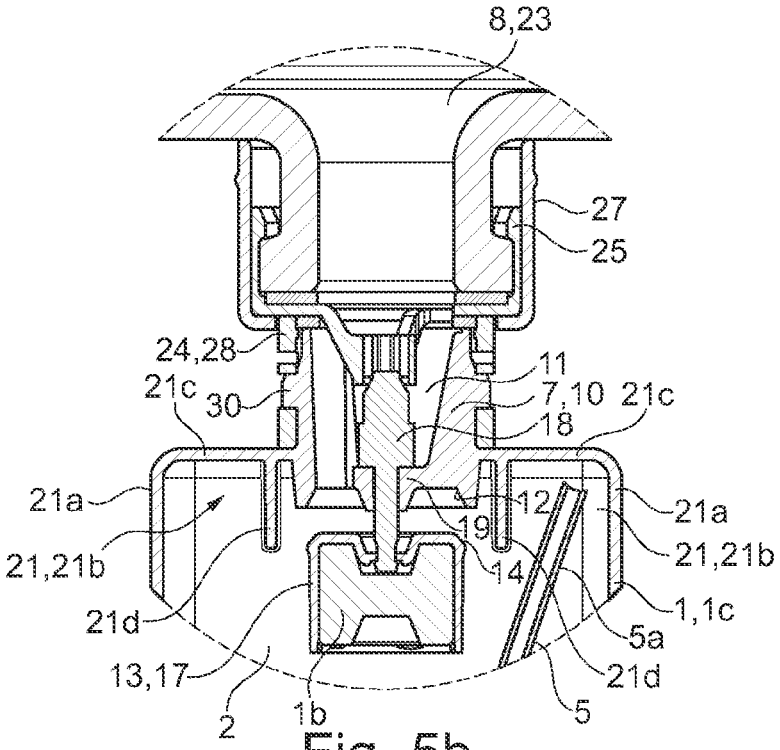

The valve 13 is arranged in order to be mobile between its closed and open positions under the effect of the gravity which is induced by the positioning of the fillable bottle respectively in an upright position (FIGS. 3*a*, 5*a*) and in a turned-over position (FIGS. 3*b*, 5*b*). As such, after unlocking of the valve 13, the filling is carried out via simple gravitational flow of the product and an air transfer in the opposite direction through the passage 11 between the source 8 of product and the reservoir 2 to be filled, the filling may be carried out by a simple gesture of mounting the fillable bottle in upright position on the source 8 of product followed by a turning over of the fillable bottle—source 8 of product unit.

In particular, the upright position corresponds to the normal position of use of the fillable bottle wherein the push-button 4 is arranged towards the top. Alternatively, the fillable bottle in upright position can be directed differently, as long as the valve 13 therein is in closed position under the effect of gravity.

The fillable bottle in upright position can be mounted and connected to the source 8 of product without inducing a transfer of product, in particular due to the absence of pressurisation of said product. Then, the turned-over position corresponds to a rotation of the fillable bottle—source 8 of product unit in order to arrange said source on top of the reservoir 2 in order to induce the filling via flow. In FIGS. 3 and 5, the rotation is 180° but it could have a different angle, provided that it is enough to open the valve 13 under the effect of gravity.

After filling, the fillable bottle—source 8 of product unit is put back into the initial position before disconnecting said bottle in order to be able to use it later. In particular, this turning over induces the closing of the valve 13 under the effect of gravity.

In relation with the figures, the valve 13 comprises an annular surface 14 which, in closed position, comes into sealed contact on the seat 12 which has a complementary surface, said surface in open position being arranged at a distance from said complementary surface. In order to improve the sealing in closed position, the surface 14 and the complementary surface of the seat 12 can be tapered.

Moreover, the valve 13 is provided with a ballast 16 of which the weight is sufficient to displace said valve between its opening and closing positions. In particular, the ballast 16 induces an effort of sealed thrusting of the annular surface 14 on the seat 12 and guarantees the separation of said surface during the turning over.

In the embodiment shown, the valve 13 is mobile in axial translation between its closed and open positions. Alternatively, possibly complementary, the valve 13 can be mobile between its closed and open positions via deformation induced by the gravity, in particular via deformation of the annular surface 14 on the seat 12.

In the figures, the valve 13 comprises an upper cage 17 having a lower bead whereon the annular surface 14 is formed, a ballast 16 added, for example with a metal base, being fixed in said cage. Alternatively, the ballast 16 can be incorporated into the valve 13, in particular by carrying out said valve with a high-density material, for example a polymer loaded with metal particles or directly of metal material.

The valve 13 comprises a lower rod 18 that extends under the cage 17, said rod being mounted slidingly in a tube 19 integral with the skirt 10, said rod and said tube being arranged in order to define the ending stroke of the displacement of the valve 13 in open position. In the embodiment shown, the upper end of the rod 18 is snap-fitted in a lower orifice of the cage 17, but said rod could be formed of a single part with said cage.

The bottle comprises a bell 21 which is arranged in the reservoir 2 in order, in upright position (FIGS. 3*a*, 5*a*), to be in communication with said reservoir and, in turned-over position (FIGS. 3*b*, 5*b*), be isolated from said reservoir in order to not be filled by the product coming from the source 8.

As such, during the emptying of the reservoir 2, a volume of air is formed which, during the turning-over, is retained in the bell 21 in order to be released into said reservoir during the returning to upright position, which makes it possible to guarantee the presence of air at the top in said reservoir after it is filled. Advantageously, the lower end 5*a* of the plunger tube 5 is arranged inside the bell 21 in order to favour the emptying of said bell in order to form the volume of air retained.

In particular, the air at the top allows for the expansion of the product during the increase in temperature without exceeding the permissible pressure in the reservoir 2, for example of a magnitude of 5 bars. This embodiment is particularly advantageous when the product contains alcohol, for example by planning that the retention volume of the bell 21 be of a magnitude of 5 to 7% of the conditioning volume of the reservoir 2.

In relation with the figures, a bell 21 is formed inside a peripheral wall that extends over a lower wall in order to form a retention volume, said walls being arranged so that said retention volume is open in the upper portion and that, in turned-over position, said retention volume is not in communication of flow with the passage 11. In particular, the peripheral wall extends axially, the lower wall extending radially.

In the embodiment of the FIG. 2, the cage 17 is provided with a lid 20 which makes it possible to isolate the ballast 16 from the contact with the product conditioned in the reservoir 2. Furthermore, the lid 20 forms a bell 21 which is integral in displacement with the valve 13 by being arranged in the reservoir 2. In particular, the lid 20 has an axial peripheral wall 20*a* that extends over a lower radial wall 20*b*, the bell 21 being formed inside said walls in order to form the retention volume which is open in upper portion.

In relation with the embodiment of FIG. 4, a bell 21 is formed inside the walls which are integral with the outer wall 1*c* of the body 1. More precisely, the reservoir 2 has two bells 21 which are formed on either side of the lower opening 1*b*, the bottom 1*d* having a transversal section of substantially parallelepiped geometry at the centre of which said opening is formed.

More precisely, each bell 21 comprises:

- portions of external wall 21*a* and lateral wall 21*b* which are formed by corresponding portions of the outer wall 1*c* of the body 1;
- a bottom portion 21*c* formed from a portion of the bottom 1*d* of the outer wall 1*c* of the body 1; and
- a bridge 21*d* arranged in the outer wall 1*c* of the body 1 in order to form an inner wall portion, said bridge extending between the lateral portions 21*b*.

In an alternative not shown, a bell 21 can be formed by a lower extension that is formed in the reservoir 2, the upper opening of said extension extending under the lower opening 1*b* of the body 1 in order to allow the retention of the volume of air during the turning over. In particular, the lower extension can extend around the skirt 10 of the relief valve for filling 7.

The source 8 of product comprises a product reservoir 23, in particular formed inside a bottle with a capacity higher than that of the fillable bottle. According to another embodiment, the source reservoir 23 is formed inside a flexible pocket which can be filled with product without air or gas for the proper conservation of said product.

The reservoir source 23 is provided with a socket 24 which is arranged in order to allow for the sealed connection of the relief valve for filling 7 on said source reservoir by putting the passage 11 into communication with it. Furthermore, the relief valve for filling 7 is provided with a sealed connecting device of the bottle on the source 8 of product, the socket 24 being provided with a connecting device which is complementary to that of the relief valve for filling 7.

The socket 24 comprises a collar 25 for mounting on the neck of the source bottle 8, said collar being fixed on said neck by means of a hoop 27. The collar 25 has an upper opening which is overmounted by a sleeve 28 extending axially in a peripheral manner. Advantageously, the socket 24 is devoid of means for pressurising the filling product. As such, the bottle 8 cannot be diverted from its role as a source as it is without propellant gas or internal pressure.

The skirt 10 of the relief valve for filling 7 is arranged to slide axially in relation to the sleeve 28 of the socket 24. In particular, the skirt 10 and the sleeve 28 are annular, the outside diameter of the skirt 10 being slightly lower than the inside diameter of the sleeve 28 in order to allow for an axial mounting without clearance of the fillable bottle on the source 8 of product. Furthermore, the skirt 10 can be slightly tapered and have a lower chamfer in order to provide a radial clamping during the axial sliding of said skirt in the sleeve 28.

In the embodiment shown, the connecting devices include lugs 30 integral with the skirt 10 or with the sleeve 28 which are intended to cooperate with ramps 31 integral with the sleeve 28 or with the skirt 10 in order to allow the mounting and the immobilisation of the fillable bottle in connected position on the source reservoir 23. In the figures, a set of two diametrically opposite lugs 30 is formed around the skirt 10 in order to cooperate with a set of two ramps 31 formed in the sleeve 28, said lugs having an upper chamfer that facilitates their introduction into the ramps 31.

Advantageously, the relief valve for filling 7 and/or the socket 24 are provided with a cap 40 arranged for maintaining the sealing of the reservoirs 2, 23 between two fillings. Each cap 40 comprises a connecting device which is complementary to that of the relief valve for filling 7 or of the socket 24. As such, the caps 40 can be removed before filling and put back after filling according to a gesture which is analogous to that respectively of the disconnection and the connection of the fillable bottle on the source 8 of product.

What is claimed is:

1. A fillable bottle for dispensing a liquid cosmetic product, comprising:

a body having an outer wall wherein a reservoir for the conditioning of said liquid cosmetic product is formed;

a device for dispensing said conditioned liquid cosmetic product which is mounted in a sealed manner on said body;

a relief valve for filling the reservoir which is arranged to allow for the putting into communication of a source of product with said reservoir for filling of said reservoir, said relief valve comprising a passage for communication between said source and said reservoir, said passage having a seat provided with a valve which is mobile relative to said seat between a sealed closed position and an open position of said passage;

characterised in that the valve is mobile between the closed and open positions under the effect of the gravity which is induced by the positioning of the bottle in an upright position and in a turned-over position, respectively, said bottle comprising at least one bell arranged within the reservoir, said bell including at least one sidewall that is radially inboard from an inside surface of the outer wall of said body and extends axially into an interior portion of the reservoir, said bell in communication with said reservoir in the upright position when the valve is in the closed position and isolated from said reservoir in the turned-over position when the valve is in the open position in order to not be filled by the liquid cosmetic product coming from the source, characterised in that the device for dispensing comprises a pump supplied with liquid cosmetic product via a plunger tube, the lower end of said plunger tube positioned inside the bell.

2. The fillable bottle according to claim 1, characterised in that the sidewall is a peripheral wall, inside which the bell is formed, that extends from a lower wall of the body in order to form a retention volume, said retention volume having an open upper portion and, in the turned-over position, said retention volume is not in communication of flow with the passage.

3. The fillable bottle according to claim 2, characterised in that the peripheral wall extends axially, the lower wall extending radially.

4. The fillable bottle according to claim 2, characterised in that the retention volume of the bell is of a magnitude of 5 to 7% of the conditioning volume of the reservoir.

5. The fillable bottle according to claim 1, characterised in that at least one portion of the bell is formed by a portion of the outer wall of the body.

6. The fillable bottle according to claim 5, characterised in that the outer wall has a bottom of which at least one portion forms the lower wall of the bell.

7. The fillable bottle according to claim 1, characterised in that at least one portion of the bell is formed by a bridge arranged in the outer wall of the body.

8. The fillable bottle according to claim 1, characterised in that the bell is integral in displacement with the valve.

9. The fillable bottle according to claim 8, characterised in that the valve comprises a lid wherein the bell is formed.

10. The fillable bottle according to claim 1, characterised in that the valve is provided with a ballast of which the weight is sufficient to displace said valve between its opening and closing positions.

11. A unit comprising a fillable bottle according to claim 1 and the source of product intended for the filling of said fillable bottle, said source comprising a liquid cosmetic product reservoir which is provided with a socket arranged in order to allow the sealed connection of the relief valve for filling on the source reservoir by putting the passage into communication with said reservoir.

12. The fillable bottle according to claim 1, wherein the device for dispensing said conditioned liquid cosmetic product is removably mounted in a top opening of said body.

13. The fillable bottle according to claim 1, wherein the relief valve for filling the reservoir is mounted in a bottom opening of said body.

14. A fillable bottle for dispensing a liquid cosmetic product, comprising:

a body having an outer wall wherein a reservoir for the conditioning of said liquid cosmetic product is formed;

a device for dispensing said conditioned liquid cosmetic product which is mounted in a sealed manner on said body;

a relief valve for filling the reservoir which is arranged to allow for the putting into communication of a source of product with said reservoir for filling of said reservoir, said relief valve comprising a passage for communication between said source and said reservoir, said passage having a seat provided with a valve which is mobile relative to said seat between a sealed closed position and an open position of said passage;

characterised in that the valve is mobile between the closed and open positions under the effect of the gravity which is induced by the positioning of the bottle in an upright position and in a turned-over position, respectively, said bottle comprising at least one bell arranged within the reservoir, said bell in communication with said reservoir in the upright position when the valve is in the closed position and isolated from said reservoir in the turned-over position when the valve is in the open position in order to retain a volume of air and not be filled by the liquid cosmetic product coming from the source, characterised in that the device for dispensing comprises a pump supplied with liquid cosmetic product via a plunger tube, the lower end of said plunger tube positioned inside the bell.

15. The fillable bottle according to claim 14, wherein the bell includes at least one sidewall radially inboard from an insider surface of the outer wall and extending into an interior portion of the reservoir.

* * * * *